US009845225B2

(12) United States Patent
Kuronen

(10) Patent No.: US 9,845,225 B2
(45) Date of Patent: Dec. 19, 2017

(54) ELEVATOR LANDING DOOR ARRANGEMENT

(71) Applicant: KONE CORPORATION, Helsinki (FI)

(72) Inventor: Mikko Kuronen, Espoo (FI)

(73) Assignee: KONE CORPORATION, Helsinki (FI)

( * ) Notice: Subject to any disclaimer, the term of this patent is extended or adjusted under 35 U.S.C. 154(b) by 99 days.

(21) Appl. No.: 14/950,164

(22) Filed: Nov. 24, 2015

(65) Prior Publication Data

US 2016/0167928 A1 Jun. 16, 2016

(30) Foreign Application Priority Data

Dec. 12, 2014 (EP) ..... 14197743

(51) Int. Cl.
*B66B 13/30* (2006.01)
*E06B 1/04* (2006.01)

(52) U.S. Cl.
CPC ..... *B66B 13/308* (2013.01); *B66B 13/306* (2013.01); *E06B 1/04* (2013.01)

(58) Field of Classification Search
CPC ..... B66B 13/306; B66B 13/308; E06B 1/04; E06B 1/12; E06B 1/14
See application file for complete search history.

(56) References Cited

U.S. PATENT DOCUMENTS 2,576,260 A * 11/1951 Metts ..... E06B 1/12 403/295
4,530,189 A * 7/1985 Randall ..... B66B 13/303 109/77
5,058,323 A * 10/1991 Gerritsen ..... E06B 1/347 49/460
5,305,855 A * 4/1994 Rivera ..... B66B 13/301 187/334
5,904,014 A * 5/1999 Ripamonti ..... B66B 13/303 49/505
6,668,494 B2 * 12/2003 Christen ..... B66B 13/306 52/204.1

FOREIGN PATENT DOCUMENTS

JP 10-7356 A 1/1998
JP 2013-52989 A 3/2013
JP 2014-69966 A 4/2014

OTHER PUBLICATIONS

JP2014069966 English Translation.*

* cited by examiner

*Primary Examiner* — Minh Truong
(74) *Attorney, Agent, or Firm* — Birch, Stewart, Kolasch & Birch, LLP

(57) ABSTRACT

An elevator landing door arrangement for installation in a landing door opening of an elevator shaft wall includes at least one door jamb and at least one protective element fixed at the door jamb which abuts with its sealing portion against the landing door opening. The protective element has a fixing portion facing the door jamb, whereby either the fixing portion is bent around a carrier element of the door jamb or the carrier element extends around the fixing portion of the protective element.

10 Claims, 1 Drawing Sheet

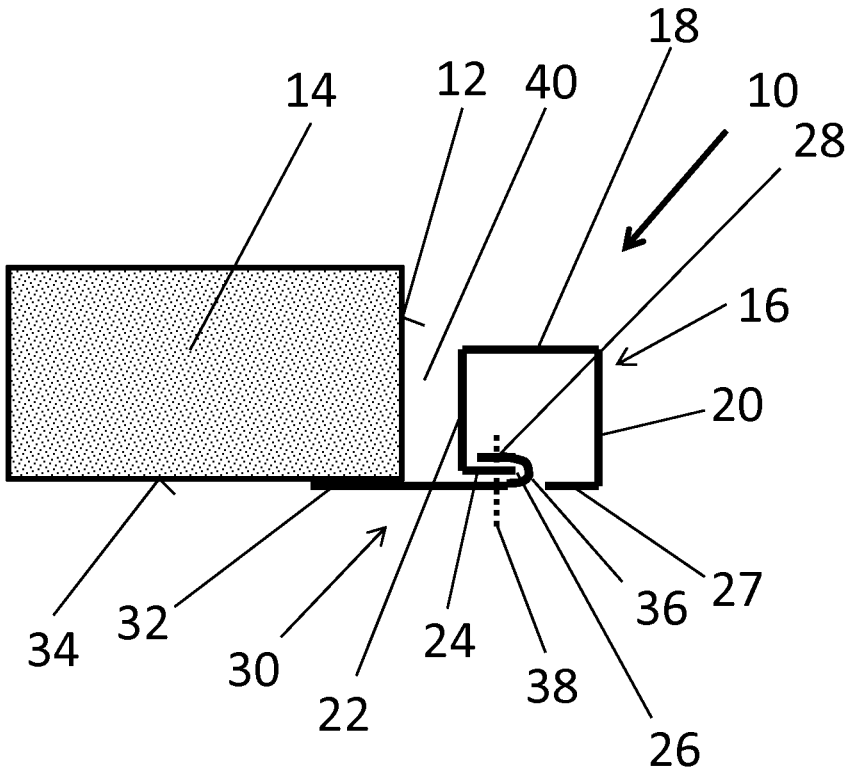
18
14
12
40
10
28
16
20
34
32
30
22
24
38
26
36
27

ELEVATOR LANDING DOOR ARRANGEMENT

The present invention relates to an elevator landing door arrangement for the installation in a landing door opening of an elevator shaft. This arrangement typically comprises a door jamb which comprises vertical door jamb parts and a horizontally extending upper door jamb part, which are connected in one piece or are rather mounted together to form the landing door frame. The door jamb is connected with a protective element which closes the gap between the door jamb and the landing door opening of an elevator shaft which is usually provided in a concrete shaft wall. On this behalf, usually plates are screwed to the door jamb as protective elements which abut against a surface of the elevator shaft wall facing the elevator shaft. This connection between the shaft wall, the protective plate and the door jamb provides required fireproof characteristics and prevents smoke from passing through the gap between the door jamb and the landing door opening. Currently, a lot of screws are used to fix the protective element tightly to the door jamb to get a tight connection thereof.

The JP H10 7356 A as well as the JP 2014 069966 A disclose an elevator door arrangement for installation in a landing door opening of an elevator shaft wall.

It is object of the present invention to provide a smoke barrier in a landing door arrangement in a more efficient way.

This object is solved with a landing door arrangement for installation in a landing door opening of an elevator shaft wall, which arrangement comprises at least one door jamb and at least one protective element fixed at the door jamb, the protective element having a fixing portion which is connected to the door jamb and a sealing portion which butts against an elevator shaft wall, whereby either the fixing portion passes around a carrier element of the door jamb or the carrier element extends around the fixing portion of the protective element. Preferred embodiments of the arrangement are subject-matter of the dependent claims. Inventive embodiments are also presented in the description part and drawings of the present application. The inventive content may also consist of several separate inventions, especially if the invention is considered in the light of explicit or implicit sub-tasks or with respect to advantages achieved. In this case, some of the attributes contained in the claims below may be superfluous from the point of view of separate inventive concepts. The features of different embodiments of the invention can be applied in connection with other embodiments within the scope of the basic inventive concept.

Whereas in conventional arrangements the protective element is simply screwed onto a surface of the door jamb, according to the invention the protective element has a fixing portion facing the door jamb which passes, e.g. is bent, around a carrier element of the door jamb. In another alternative embodiment, the carrier element passes around the fixing portion of the protective element. Although both alternatives are possible to provide a better sealing against the passing of smoke through the gap between the door jamb and the landing door opening, the first alternative is preferred because it is easier to provide the protective element with a bent fixing end. Of course the bending of the fixing portion can be made by bending a metal sheet plate or by moulding a protective element as to have a curve or bending, which passes around the carrier element. By the measure, that one of the protective element or the carrier element passes around the other one, a kind of labyrinth seal is formed, which prevents smoke from passing though that connection. On the other hand that bending facilitates the installation of the protective element at the door jambs because when the bending of the fixing portion of the protective element butts against the free edge of carrier element the protective element is in its correct position with respect to the door jamb.

According to the invention the carrier element is a fixing ridge of the door jamb which is either provided additionally to the door jamb profile, e.g. as a separate part or in a simple solution forms an integral part of the door jamb profile. This has the advantage that the door jamb profile does not particularly be modified to carry the protective element. So only a of the door jamb profile having a free edge is used as the carrier element.

According to the invention the fixing ridge of the door jamb is a one piece part together with the door jamb. This arrangement has the advantage that the number of parts to be used in the construction of the arrangement is lessened. On the other hand, there are no further gaps to be sealed to meet fire protection regulations.

Preferably, the fixing portion is passed around the carrier element, e.g. via a bending by 180 degrees so that it butts against the carrier element on opposite sides which improves the density of the abutting connection between the protective element and the carrier element of the doorjamb.

Of course, the carrier element is preferably further fixed to the carrier element by fixing elements, preferably bolts, particularly by screw bolts which pass through the carrier element and the two layers of the fixing portion of the protective element passing around the carrier element. If the carrier element passes around the fixing portion of the protective element, the screws for fixing the protective element to the door jamb go through two layers of the carrier element and one layer in between of the protective element. In either arrangement, less screw bolts or other fixing elements are necessary to keep the protective element tightly to the door jamb as to provide a safe smoke barrier between the door jamb and the landing door opening in the elevator shaft wall.

Preferably, two parts of the fixing portion of the protective element adjacent the bending are fixed together via fixing elements, preferably bolts, with the carrier element in between. This arrangement is extremely easy to install as the protective element can be placed with its opening against the carrier element of the door jamb and then drawn so that the carrier element inserts into the adjacent portions of the fixing element adjacent to the bending. The fixing is easy by making perforations through the layers and securing the perforations with bolts, particularly with screw bolts. Such a fixing is also fireproof and meets the requirement for fire protection.

Preferably, the carrier element or fixing ridge is arranged on of forms a backside part of the door jamb profile facing to the elevator shaft. At that side, a door jamb profile building the door jamb may be open so that this profile back wall may have a free edge around which the bent fixing portion of the protective element can pass. This embodiment is easy to produce, leaves the option of the fixing of a protective element to the door jamb open and does not affect the optical impression of the door jamb parts visible by the users of the elevator.

Preferably, the fixing portion of the protective element is located at the opposite end of the sealing portion so that the complete area of the protective element in between can effectively seal the gap between the door jamb and the elevator shaft wall.

Preferably, the fixing the carrier element (or fixing ridge) and the door jamb are made of metal which meets the safety requirements for door jambs and the corresponding protective elements in elevators with respect to fire-protection regulations.

Of course, the door jamb may have vertically extending door jamb parts as well as an upper horizontally extending door jamb part which build together the door jamb of the landing door which is to be sealed against the surrounding concrete wall of the elevator shaft.

In a very economic solution of the invention, the protective element is a metal sheet plate. Anyway, it may consist of any material which corresponds to fire-protection regulations, e.g. polymer-concrete etc.

Of course, the invention also refers to an elevator comprising an arrangement according to the above-described specifications, whereby this arrangement is located in a landing opening of an elevator shaft wall which is preferably made of concrete.

The invention is now schematically explained by means of an embodiment, whereby

FIG. 1 shows a horizontal cross-section through the connecting area between a vertical door jamb part and the adjacent concrete elevator shaft wall.

FIG. 1 shows an elevator landing door arrangement 10 located in a landing door opening 12 which is provided in a concrete elevator shaft wall 14 of an elevator. The arrangement comprises a door jamb 16 embodied as a rectangular door jamb profile with a front part 18, a first side part 20 facing the landing area, a second side part 22 facing the landing opening 12 and a first backside part 24 having a free edge 26 and a second backside part 27 which two backside parts 24, 27 together form the backside of the door jamb profile 16 facing the elevator shaft. The first backside part 24 of the door jamb profile 16 forms a carrier element for supporting a protective element 30 closing the gap 40 between the door jamb profile 16 and the concrete shaft wall 14. Accordingly, connected to the carrier element 24 and passing around its free edge 26 is a fixing portion 28 of the—preferably plate-like—protective element 30 which butts with its sealing portion 32 against the shaft side surface 34 of the elevator shaft wall 14. The fixing portion 28 of the protective element 30 has a bending 36 which surrounds the free edge 26 of the carrier element 24 of the door jamb profile 16. Via this arrangement, the fixing portion 28 of the protective element 30 butts tight against the carrier element 24 of the door jamb profile at two surfaces in a kind of labyrinth seal, so that no smoke or fire can pass this connection.

The connection between the door jamb profile 16 and the protective element 30 is secured by fixing elements 38, particularly bolts, particularly screw bolts, which pass through the two layers of the fixing portion 28 of the protective element 30 adjacent to the bending 36, and through the carrier element 24 located in between. The fixing elements 38 therefore press these three layers together so that this connection is tight against passing smoke or fire. Via this means, the protective element 30 is in a sealed manner and rigidly connected to the door jamb profile 16 so that the gap 40 between the door jamb 16 and the elevator shaft wall 14 (whose width is exaggerated in the FIGURE for clarity reasons) is effectively closed.

It shall be clear for the skilled person that the invention is not restricted to the shown embodiment but may be varied within the scope of the appended patent claims.

The invention claimed is:

1. An elevator landing door arrangement for installation in a landing door opening of an elevator shaft wall, comprising:

at least one door jamb having a backside surface with an opening, wherein the backside surface comprises two backside parts facing one another with said opening located between said two backside parts, wherein the backside surface faces an elevator shaft; and at least one protective element fixed at the at least one door jamb, wherein the at least one protective element comprises a fixing portion connected to the at least one door jamb and a sealing portion which butts against a side surface of the elevator shaft wall, wherein the fixing portion passes around an outer surface of a first backside part of said two backside parts, through said opening into an interior space of said at least one door jamb and around an inner surface of the first backside part, and wherein the fixing portion is connected to the at least one door jamb via a fastener that extends through the fixing portion and the first backside part.

2. The arrangement according to claim 1, wherein the fixing portion is passed around the first backside part by 180 degrees.

3. The arrangement according to claim 2, wherein the at least one door jamb has a rectangular profile.

4. The arrangement according to claim 1, wherein the at least one door jamb has a rectangular profile.

5. The arrangement according to claim 1, wherein the at least one door jamb is made of metal.

6. The arrangement according to claim 1, wherein the at least one protective element is a metal sheet plate.

7. The arrangement according to claim 1 wherein the fixing portion and the first backside part form a labyrinth seal.

8. The arrangement according to claim 1, wherein the fixing portion of the at least one protective element is located at a first end of the protective element, and wherein the sealing portion is located at a second end of the protective element, the second end being opposite to the first end.

9. An elevator comprising the elevator door landing arrangement according to claim 1 in at least one landing opening of an elevator shaft wall.

10. The elevator according to claim 9, wherein the elevator shaft wall is made of concrete.

* * * * *